United States Patent [19]

Baluha et al.

[11] 4,334,958

[45] Jun. 15, 1982

[54] PRODUCTION OF CONVEYOR SUPPORT BARS FOR PAPER MAKING MACHINERY

[75] Inventors: Gerald F. Baluha, Flat Rock; Bernard E. Flanagan, Hendersonville, both of N.C.

[73] Assignee: Fred W. Meyers, Gilbert, S.C.

[21] Appl. No.: 180,829

[22] Filed: Aug. 25, 1980

[51] Int. Cl.[3] ..... D21F 1/54

[52] U.S. Cl. ..... 162/352; 162/374

[58] Field of Search ..... 162/352, 374

[56] References Cited

U.S. PATENT DOCUMENTS

| | | | |
|---|---|---|---|
| Re. 29,418 | 9/1977 | Hunt | 162/352 X |
| 3,393,124 | 7/1963 | Klingler et al. | 162/352 |
| 3,928,125 | 12/1975 | Poeschl | 162/352 |
| 4,106,981 | 8/1978 | Corbellini | 162/352 |
| 4,162,937 | 7/1979 | Corbellini | 162/352 |
| 4,265,706 | 5/1981 | Fulton | 162/352 |

FOREIGN PATENT DOCUMENTS

| | | |
|---|---|---|
| 1029996 | 4/1978 | Canada . |
| 789972 | 11/1967 | Italy . |
| 917248 | 5/1972 | Italy . |

*Primary Examiner*—Richard V. Fisher
*Attorney, Agent, or Firm*—Luke J. Wilburn, Jr.; Wellington M. Manning, Jr.

[57] ABSTRACT

An elongate support bar of composite material for transverse support of a moving conveyor of a paper making machine, wherein the bar is composed of a wear-resistant nose portion of smooth, hard material, such as a plurality of ceramic plates, and a base portion of polymeric resinous material in which plates are adhesively secured. The undersurface of the base portion of the bar is provided with an elongate channel for slideable securement to a transverse support member of the paper making machine, and the bar is supported and dimensionally stabilized by a plurality of flexible filamentary strands of high tensile strength embedded within the resinous base portion in spaced relation and extending along the length of the bar. The ceramic nose portion is particularly formed of a plurality of abutted ceramic plates which are interlaced and positively supported by a filamentary strand, and the bar is characterized by the absence of internal metal channel supports heretofore employed for support of composite bar constructions of the prior art.

Also disclosed is a molding device for producing the composite bar constructions. The mold forming plates of the molding device are positionally adjusted by support frame members located along the length of the mold to provide accurate and precise formation of the elongate support bar along its full length.

9 Claims, 10 Drawing Figures

PRODUCTION OF CONVEYOR SUPPORT BARS FOR PAPER MAKING MACHINERY

This invention relates to the production of conveyor support devices for use in paper making machinery, and, more particularly, to an improved elongate bar construction for transversely supporting the undersurface of a moving screen type conveyor of paper making machinery, and to molding apparatus for producing such support bars.

BACKGROUND OF THE INVENTION

Various types of conveyor support bars for use in paper making machinery are known. Typically, such support bars are positioned beneath and extend transversely across the path of movement of a conveyor of a paper making machine to supportably engage the undersurface of the conveyor. In the Fourdrinier type paper making machine, the bars are particularly shaped and spaced beneath the screen carrying the paper pulp slurry to provide for vacuum removal of water from the slurry on the upper surface of the screen during the paper making operation. Such water removal bars, also known as foils or blades, can be employed with positive suction boxes below the screens, or their upper surfaces may be angled so as to create a suction effect beneath the screen surface to draw the water from the pulp slurry carried thereon as the screen moves longitudinally thereover.

Such water removal foils and support bars are of a continuous length to span the width of the longitudinally moving screen and may be of a length of as much as forty feet for this purpose. A high degree of accuracy and alignment of the bar with the moving screen is required to ensure proper seal for water removal from the slurry, and to reduce the wear on the screens during the paper making process.

To increase wear resistance of the bars, and reduce wear on the screens engaged thereby, it has been a practice to construct the bars with a hard, smooth, wear-resistant nose portion formed of a metal alloy or a ceramic material, such as alumina, which engages the surface of the screen. The wear-resistant nose, or blade, portion is adhesively bonded in a resinous material, such as an epoxy resin, which is in turn adhesively secured to a base member, such as polyethylene. The polyethylene base member is provided with an elongate channel which is slidably received on a fixed transverse support member of the frame of the paper making machine.

Such bars are strengthened by elongate metal channel members which are embedded within the epoxy resin and extend along the length of the bar to provide dimensional support thereto during installation and use. The wear-resistant nose portion of the bar which sealingly engages the undersurface of the moving screen is generally composed of a plurality of short ceramic plates positioned in endwise abutment in the epoxy resin along the length of the bar, and the ends of the plates are interconnected by metal pins disposed in mating grooves of the plates to position the plates in surface alignment for continuous engagement with the undersurface of the conveyor screen. Support bars of the type herein described are disclosed in prior U.S. Pat. Nos. 3,393,124; 4,106,981; Canadian Pat. No. 1,029,996; and Italian Pat. Nos. 789,972 and 917,248.

Although metal-reinforced support foils and bars with ceramic nose portions find wide use in the paper making industry, many problems are encountered in their use because of stresses and forces which act on the bar as a result of differential thermal expansion and contraction of the different composite materials employed therein. The differential thermal expansion and contraction of the metal reinforcing components which are embedded in the resinous components of the bar work against the expansion and contraction of the resinous components to cause cracking and delaminating of the bars after a time of use. Such differential forces acting on the bar also often cause displacement and improper alignment of the ceramic plates of the nose portion of the bar which engage the undersurface of the screen, resulting in non-uniform water removal from the slurry and greater wear on the screens, necessitating periodic replacement of the screens and bars during the paper making process.

BRIEF OBJECTS OF THE INVENTION

Accordingly, it is a primary object of this invention to provide an improved support bar for use in transverse support of a moving screen or other conveyor of a paper making machine wherein the aforementioned problems caused by differential thermal expansion and contraction of the components of the bar are minimized.

It is another object to provide an improved water removal foil or bar of high strength and dimensional stability which eliminates the need for metal reinforcing members therein.

It is another object to provide a water removal foil or support bar for paper making machinery conveyors having longer life and reliability than foils and bars of the prior art.

It is a further object to provide improved molding apparatus for the manufacture of conveyor support bars for paper making machines.

SUMMARY OF THE INVENTION

Briefly, the present invention comprises an improved composite material support bar for use in paper making machinery having a nose portion of a smooth, hard wear-resistant material, such as sintered alumina, adhesively secured in a base portion which is comprised of polymeric resinous materials. The bar is reinforced by a plurality of flexible filamentary strands of material of high tensile strength embedded in the resinous base in spaced relation to extend along the length of the bar. The wear resistant nose portion of the bar comprises a plurality of ceramic plates which are disposed in abutting endwise relation in the polymeric resin, and the plates are maintained in alignment and dimensionally stabilized by a flexible filamentary strand which interlaces about side portions of the plates, with cross over of the strands at the abutting ends of the plates along the length of the bar.

In a preferred embodiment, the base portion of the bar is composed of a lower section of thermoplastic resinous material, such as polyethylene, having an elongate channel in its lower surface for sliding attachment of the bar to a fixed transverse support member of the paper making machine. The upper section of the base portion in which the filamentary strands of material are embedded is preferably composed of a thermosetting epoxy resin which bonds to the upper surface of the polyethylene section and secures the ceramic nose portion of the bar in fixed position to form the upper screen-engaging surface of the bar.

The elongate composite support bar is accurately and precisely formed in an elongate mold device having means for precise adjustment of the molding surfaces of the device along its length to ensure accurate alignment of the ceramic plates of the nose portion and proper positioning of the reinforcing filamentary strands and a preformed lower section of the base portion for securement by the epoxy resin.

BRIEF DESCRIPTION OF THE DRAWINGS

The above as well as other objects of the invention will become more apparent, and the invention will be better understood, from the following detailed description of preferred embodiments thereof, when taken together with the accompanying drawings, in which.

DETAILED DESCRIPTION OF PREFERRED EMBODIMENTS

Figure 1:
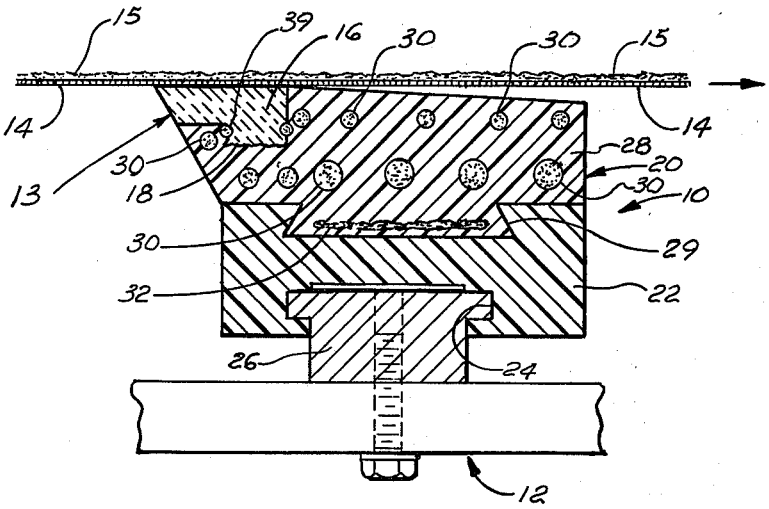
FIG. 1 is a vertical cross-sectional view of one form of support bar of the present invention, showing the disposition of the components therein, and illustrating the position of the bar in support of a porous moving conveyor screen of a paper making machine.

Referring more specifically to the drawings, FIG. 1 illustrates in vertical cross-section, an elongate water removal bar or foil 10 of the present invention. In use, the bar 10 is supported on an elongate transverse support member 12 of the frame of a paper making machine, with an upper leading edge or nose portion 13 of the bar in supporting engagement with a moving porous conveyor 14 of a paper making machine of the Fourdrinier type. As is well known in the paper making art, such screen conveyors are composed of a suitable porous web material, such as metal wire, fabric or the like, and they supportably transport a liquid slurry of paper pulp 15 thereon during the paper making operation. As the screen moves in a generally horizontal path of travel, in the direction indicated by the arrow in FIG. 1, a plurality of such water removal bars 10, which typically may be of a continuous length of between 20 to 40 feet, are located in spaced parallel relation along the path of movement of the screen and span the width of the screen in engagement therewith to facilitate withdrawal of liquid from the pulp slurry during screen movement. The location of such bars in paper making machinery, and their operation in liquid removal from the slurry in the paper making process is well known in the art, and details thereof will not be described herein.

Figure 1A:
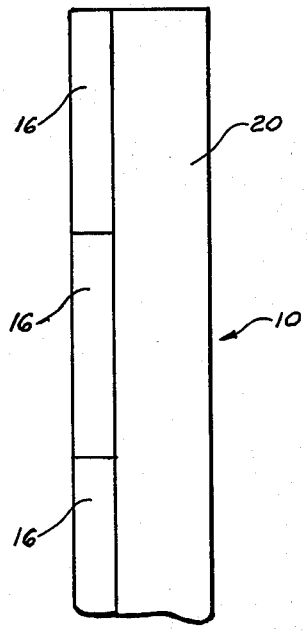
FIG. 1*a* is a plan view of an end portion of the bar of FIG. 1.

In the embodiment shown in FIGS. 1 and 1*a*, the support bar 10 comprises a nose portion of smooth hard wear-resistant material, such as a plurality of ceramic plates 16 of sintered alumina, which are disposed in endwise abutment in a row extending along the length of the bar. As seen in FIG. 1, the upper smooth surface of the ceramic plates supportably engages the undersurface of the moving porous screen 14 to form a seal with the pulp slurry on the upper surface of the screen. Each of the plates 16 has a downwardly extending foot portion 18 adhesively embedded in and supported by a base portion 20 of the bar which is comprised of a polymeric resinous material. Base portion 20 of the bar is composed of a lower section 22 of thermoplastic resinous material, such as polyethylene. The lower surface of section 22 is provided with an elongate, generally T-shaped channel 24 which is slidingly received on a corresponding T-shaped bracket 26 of the transverse support member 12 of the paper making machine. An upper section 28 of the base portion 20 of the bar is preferably formed of a thermosetting polymeric resin, such as an epoxy resin, which forms an adhesive bond with the upper surface of the polyethylene lower section 22, and the upper face of the polyethylene section has a dove-tailed channel 29 to facilitate securement of the two sections into a composite resinous support.

As seen in FIG. 1, the smooth flat upper surface of the upper section 28 is disposed at a small angle of 3° to 5° to the surface of plates 16 of the bar and diverges away from the surface of the screen 14 in the direction of screen movement so that its divergence creates a suction effect between the screen and bar 20 to facilitate removal of liquid from the pulp slurry 15 on the screen.

Embedded within the epoxy resin material section 28 of the base portion 20 of the bar are a plurality of flexible continuous filamentary strands 30 of high strength which extend in parallel spaced relation continuously throughout the length of the bar to provide reinforcement, support, and dimensional stability to the bar during its installation and use in the paper-making machine. The strands are preferably formed of polymeric resinous material, such as multi-filament braided strands of aramid polymer filaments of the type sold under the trademark Kevlar by E. I. DuPont. Such strand materials are flexible, lightweight and have a high modulus of elasticity, low elongation, and exceptional tensile strength. Other high strength filamentary materials, such as glass, steel wire, or graphite strands may also be employed as reinforcement in the bar construction of the present invention. Also embedded in the epoxy resin of section 28 and located within the upper channel 29 of the lower section 22 of the bar is a continuous length web 32 of parallel strands of the reinforcing filamentary material which is located on a central longitudinal axis of the bar to provide further reinforcement and support therefor.

Figure 2:
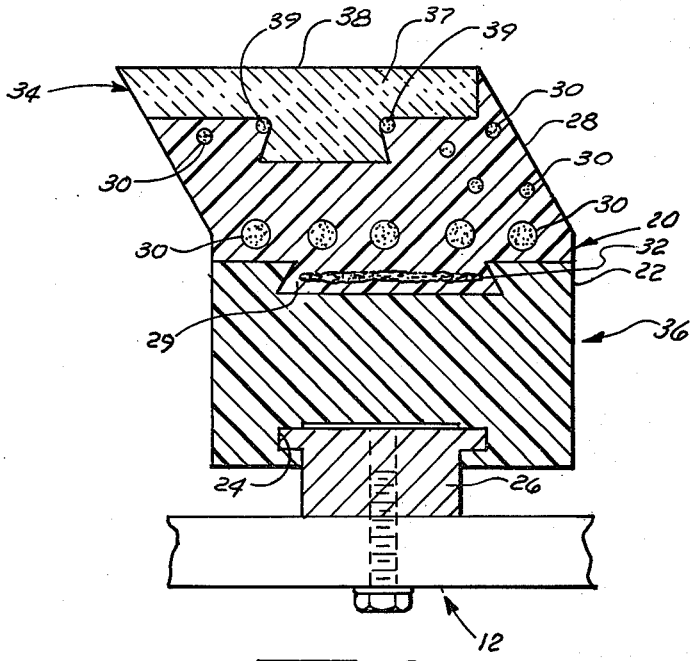
FIG. 2 is a vertical cross-sectional view of a modified form of construction of support bar of the present invention.

FIG. 2 shows a modified form of the bar construction of FIG. 1 to the extent that the hard wear-resistant nose portion 34 of the bar 36 comprises a plurality of abutted ceramic plates 37, the smooth upper surface 38 of which forms the entire upper surface of the bar to supportably engage the moving conveyor of a paper making machine. The component parts of the bar construction of FIG. 2 are otherwise the same as the component parts of the FIG. 1 bar, and like numbers have been employed to identify the same.

The entire upper surface of the bar 36 is in the same plane to make full contact with the undersurface of the conveyor screen, and positive suction means, such as a conventional vacuum box arrangement (not shown) beneath the water removal bars is employed to draw the liquid from the pulp slurry through the conveyor screen.

The row of ceramic plates 16 and 32 of the respective bar embodiments of FIGS. 1 and 2 are secured in endwise abutment in the row and positionally stabilized by a strand of filamentary material 39 which is enlaced about the row of plates, in a manner which will be explained.

Figure 3:
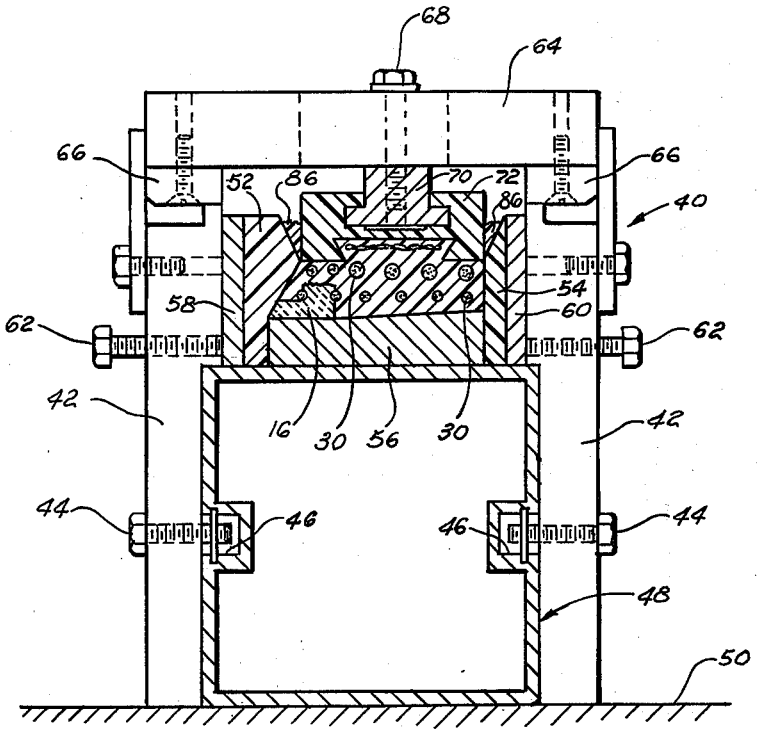
FIG. 3 is a vertical cross-sectional view of an elongate molding device employed in manufacture of support bars of the present invention.
Figure 4:
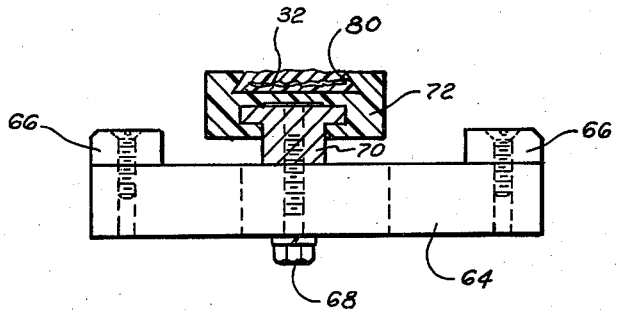
FIG. 4 is a vertical cross-sectional view of the upper support bracket of the molding device of FIG. 3, with the bracket shown in an upside down position as it is disposed in one step of the molding process.
Figure 5:
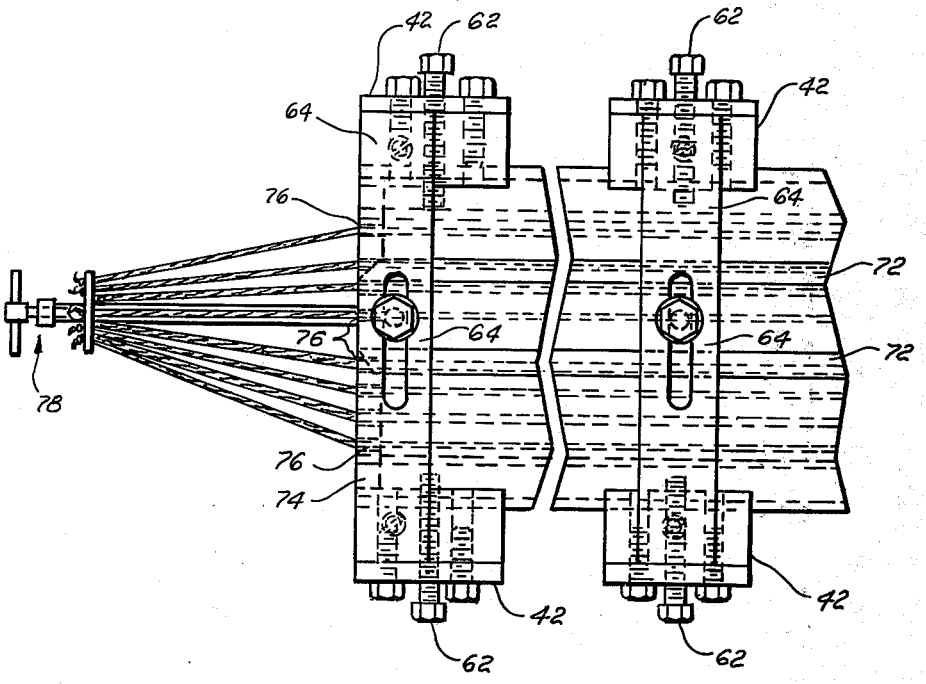
FIG. 5 is a plan view of an end portion of the molding device of FIG. 3, illustrating the spacing and arrangement of support members of the mold device along a length thereof.
Figure 6:
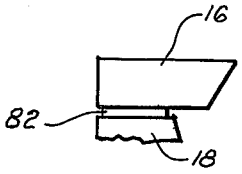
FIG. 6 is an enlarged vertical end view of one of the ceramic plates which form the nose portion of the bar shown in FIG. 1.

FIGS. 3–6 illustrate details of the a molding device for manufacturing the elongate support bars of the present invention. As seen in FIGS. 3 and 5, the mold device 40 comprises an adjustable support frame, including a plurality of vertical support member 42, opposed pairs of which are disposed in spaced locations along the length of the mold. Support members 42 are secured by adjustable fastening bolts 44 in side channels 46 of the vertical walls of an elongate rectangular heater conduit or tube 48 through which a heating medium, such as hot water, is circulated during the molding operation. The molding device is supported on the flat surface of a suitable mold support, such as an elongate table, the surface of which is illustrated schematically at 50 in FIG. 3.

The shaping surfaces of the mold device are formed of removable elongate side plates 52, 54 and a bottom plate 56 of quick-release material, such as polyethylene, which define an elongate open top cavity to receive a flowable resinous material during the molding operation. As seen in FIG. 3, the side plates 52, 54 of polyethylene are horizontally adjustably secured in seal tight relation with the bottom plate 56 by means of intermediate elongate plates 58, 60 of metal, such as aluminum, which may be horizontally adjusted by means of adjusting screws 62 disposed along the length of the mold in the upright support members 42.

The upper portion of the molding cavity and the opposed pairs of vertical support members 42 is spanned by a plurality of removable support brackets 64 (FIGS. 3–5), ends of which carry adjustable shim blocks 66 which rest on the upright support brackets 42 of the frame. Attached to midportions of each of the support brackets 64 by bolts 68 is an elongate inverted T-shaped support bar 70 which slidably receives and supports a preformed elongate bar 72 of resinous polymeric material, such as polyethylene, which forms the lower section 22 of the base portion 20 of the composite water-removal bar 10 of FIG. 1. The preformed polyethylene bar 72 is produced in conventional manner, as by molding or extruding, and it extends the full length of the elongate molding cavity of the molding device.

The mold cavity of the molding device 40 is of continuous length to form single continuous length support bars. The length of the cavity and mold device typically may be as much as 40 feet where bars of such length are required for screen support in the paper making machinery. As seen in FIG. 5, each end of the mold cavity is enclosed by an end plate 74 of polyethylene having openings 76 therethrough to receive and support the continuous filament reinforcing strands 30 in spaced relation in the cavity during the molding operation. The strands 30 are secured at each end of the mold, under desired tension, by attachment to an adjustable bracket member 78, one of which is seen in FIG. 5.

The method of forming the support bars of the present invention may be described as follows. The polyethylene plates 52, 54, 56 forming the mold cavity shape are removed from the mold support frame. The upper horizontal support brackets 64 of the frame containing the T-shaped bar 70 are placed on top of the spaced vertical support members 42 along the length of the mold. The distance between the bottom surface of the T-bar 70 and the upper flat surface of the heater tube 48 is accurately adjusted to a desired uniform distance along the full length of the mold by means of the adjustable shim blocks 66 on each end of each horizontal bracket 64. When the distance of the bottom surface of the T-bar 70 to the upper surface of the heater tube is uniform throughout the full length of the mold, the horizontal bracket 64 and attached T-bar are removed from the mold frame members 42 and placed in an upside down position, as seen in FIG. 4. The continuous length polyethylene bar 72 is then slidably placed onto the T-bar 70. A first thin layer of flowable, uncured epoxy resin is poured into the dove-tail channel 80 of the polyethylene bar and a web of reinforcing filamentary strands 32 is placed on top of this first layer of epoxy resin. The dove-tail channel 80 of the bar is then filled, as seen in FIG. 4, with flowable epoxy. The horizontal bracket is left in the position shown in FIG. 4 until the epoxy has gelled to a tacky state.

Figure 7:
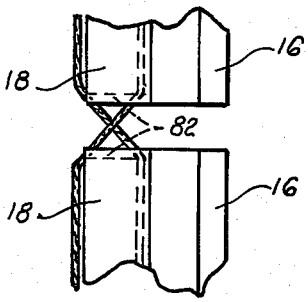
FIG. 7 is a broken away bottom view of a portion of two ceramic plates which form the nose portion of the bar of FIG. 1, illustrating the plates in non-abutment and the manner in which the plates are aligned and secured in abutment in the composite bar of FIGS. 1 and 2.
Figure 8:
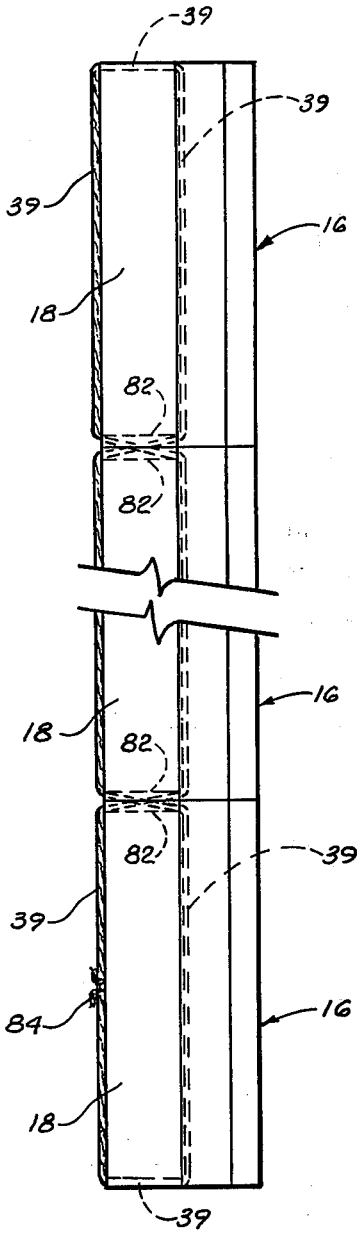
FIG. 8 is a bottom view of the row of ceramic plates forming the nose portion of the bar of FIG. 1, with a mid-portion of the row removed, and showing securement of the plates in abutment by a filamentary strand of material.
Figure 9:
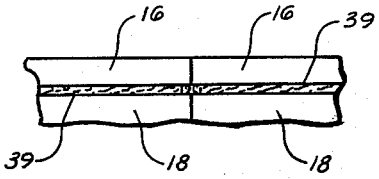
FIG. 9 is a side elevation view of end portions of two abutting plates in the row of plates in FIG. 8.

The polyethylene plates 52, 54, 56 forming the mold cavity are inserted into the mold support frame and secured in fluid-tight relation by adjusting bolts 62. The ceramic plates 16 are then placed into the mold cavity, as shown in FIG. 3, in endwise abutment along the full length of the cavity. As best illustrated by FIGS. 6–9, the plates 16 are then slightly separated (FIG. 7) and interlaced about their base portions with the continuous filamentary strand 39, such as a Kevlar polymer strand. The strand is criss-crossed about the sides of the plates in the row, as illustrated in FIGS. 7 and 8, so that strand portions cross each other at the abutting ends of the plate to reside within transverse mating grooves 82 in the ends of the plates. The interlacing strand 39 is then pulled tight and the two free ends of the strand are tied, as at 84 (FIG. 8) to align and firmly secure the abutting plates of the row together. The polyethylene end plates 74 of the cavity are then secured to the ends of the cavity as by clamps, not shown, and the reinforcing strands 40 are strung through the predrilled holes in the plates, placed under tension, and secured at opposite ends of the mold to the bracket arms 78.

When the epoxy in the dove-tail channel 80 of the preformed polyethylene bar 72 has set up to a tacky state, epoxy resin in flowable form is poured into the full length of the mold cavity containing the reinforcing strands 30 and the ceramic nose plates 16 positioned as shown in FIG. 3. The horizontal support bracket 64 is then turned over and placed on top of the mold cavity, as shown in FIG. 3, and secured thereto at each of the spaced support members 42 by suitable means, such as adjustable C-clamps (not shown). Any excess epoxy resin which is poured into the mold cavity is forced from the cavity during downward movement of the polyethylene bar 72, and the excess or overflow is retained in V-shaped continuous overflow channels 86 (FIG. 3) formed between the polyethylene bar and angled upper surfaces of the side plates 52, 54 of the mold. Heating fluid at a desired temperature is circulated through the heater tube 48 for a sufficient period of time to fully set, cure and cross link the epoxy resin and bond the same to the row of ceramic plates 16 and the polyethylene bar 72 forming the lower portion of the composite bar 10.

Preferably the curing temperature during the molding process is maintained approximately the same temperature to which the bar will be subjected during its use in the paper making machinery. Typically, if the temperature of the paper making operation is 140° F., the mold is heated at approximately 140°–150° F. for the period necessary to cross link and cure the epoxy resin in the composite bar product.

Upon completion of the cure, the horizontal upper brackets 64 of the mold frame are unclamped, the adjusting bolts for the side plates 52, 54 of the mold cavity are loosened, end plates 74 removed, and the side plates slid out of the length of the mold. The upper support brackets 64 may then be lifted vertically to raise the composite support bar from the molding device, after which the bar 10 is slideably removed from the T-bar support of the bracket, cleaned, and polished to remove any excess resin from the finished product.

From the foregoing description of the preferred embodiments of the present invention, it can be seen that the composite support bars of the invention which are reinforced with flexible filamentary strands throughout their elongate length may be manufactured and employed without the need of metallic reinforcing elements therein, and can be molded during their manufacture to precise tolerances and accurate dimensions in the molding device hereinbefore described. Although only two bar shapes have been illustrated in FIGS. 1 and 2 of the drawings, it can be understood that the bar constructions of the present invention may be molded in various shapes and sizes, depending upon the particular end uses for which the bars are to be employed.

That which is claimed is:

1. A relatively rigid elongate bar for transversely supporting the undersurface of a moving conveyor of a paper making machine, said bar comprising an elongate base portion of synthetic polymeric material, an elongate nose portion of wear-resistant material adhesively secured directly in said base portion of synthetic polymeric material and having a smooth, hard surface for supportably engaging the undersurface of the conveyor across its width, and a plurality of flexible, elongate strands of filamentary material of high tensile strength embedded in said base portion of synthetic polymeric material and extending in generally parallel spaced relation along the longitudinal axis of the bar to reinforce and support the same, said bar being further characterized by the absence of any metal exposed along the length of the bar for support of the same.

2. A support bar as defined in claim 1 wherein said plurality of strands of material include a web of generally parallel strands embedded in said base portion of synthetic polymeric material and extending along a central longitudinal axis of the bar to provide reinforcement thereof, and a plurality of separately spaced strands extending in generally parallel spaced relation along longitudinal axes of the bar.

3. A support bar as defined in claim 1 wherein said strands are composed of synthetic polymeric material.

4. A support bar as defined in claim 1 wherein all components of the bar are non-metallic materials.

5. A relatively rigid elongate bar for transversely supporting the undersurface of a moving conveyor of a paper making machine, said bar comprising an elongate base portion of synthetic polymeric material, an elongate nose portion of wear resistant material adhesively secured in said base portion of synthetic polymeric material and having a smooth, hard surface for supportably engaging the undersurface of the conveyor across its width, and a plurality of flexible, elongate strands of filamentary material of high tensile strength embedded in said base portion of synthetic polymeric material and extending in generally parallel spaced relation along the longitudinal axis of the bar to reinforce and support the same, said nose portion comprising a row of wear resistant plates positioned in endwise abutment in the synthetic polymeric base material along the length of the bar, and wherein said plurality of flexible elongate strands includes a strand interlaced about said row of plates and embedded in said synthetic polymeric material to maintain alignment and positionally stabilize the plates along the length of the bar.

6. A support bar as defined in claim 5 wherein abutting ends of said wear-resistant plates have opposed grooves therein, and said interlaced strand is disposed with portions thereof in crossing relation in said grooves to proceed about alternating sides of the plates in the row and maintain their abutment and surface alignment in the bar.

7. A support bar as defined in claim 5 wherein said base portion comprises a lower elongate section of polymeric resinous material having an elongate channel therein for slideable securement of the bar on an elongate bar-supporting support member of a paper making machine, and an upper section of resinous polymeric material adhesively bonded to said lower section with said row of wear-resistant plates embedded therein, and wherein said filamentary strands are embedded in said upper polymeric material section of the base portion of the bar.

8. A support bar as defined in claim 7 wherein said plates are formed of a ceramic material, said lower section of the base portion is polyethylene, and said upper section of the base portion is an epoxy resin.

9. A relatively rigid elongate bar for transversely supporting the undersurface of a moving conveyor of a paper making machine, said bar comprising an elongate base portion of synthetic polymeric material, an elongate nose portion comprised of a row of wear resistant plates disposed in abutting relation along the length of the bar and adhesively secured in said base portion of synthetic polymeric material, said plates forming a smooth hard surface for supportably engaging the undersurface of the conveyor across its width, and a plurality of flexible elongate strands of filamentary material of high tensile strength embedded in said base portion of synthetic polymeric material and extending in generally parallel spaced relation along the longitudinal axis of the bar to reinforce and support the same, said plurality of strands including a strand interlaced about said row of plates and embedded in the synthetic polymeric material to maintain alignment and positionally stabilize the plates along the length of the bar.

* * * * *

UNITED STATES PATENT AND TRADEMARK OFFICE

CERTIFICATE OF CORRECTION

PATENT NO. : 4,334,958

DATED : June 15, 1982

INVENTOR(S) : Gerald F. Baluha and Bernard E. Flanagan

It is certified that error appears in the above-identified patent and that said Letters Patent are hereby corrected as shown below:

In the Abstract, line 16, "positively" should read--positionally--.

Signed and Sealed this

*Seventeenth* Day of *August 1982*

[SEAL]

*Attest:*

GERALD J. MOSSINGHOFF

*Attesting Officer*

*Commissioner of Patents and Trademarks*